US011219319B2

(12) United States Patent
Kulik

(10) Patent No.: US 11,219,319 B2
(45) Date of Patent: Jan. 11, 2022

(54) CONVERTIBLE BED BUMPER APPARATUS

(71) Applicant: Milliard Enterprises Limited Liability Company, Lakewood, NJ (US)

(72) Inventor: Sima Kulik, Toms River, NJ (US)

(73) Assignee: Milliard Enterprises Limited Liability Company, Lakewood, NJ (US)

( * ) Notice: Subject to any disclaimer, the term of this patent is extended or adjusted under 35 U.S.C. 154(b) by 0 days.

(21) Appl. No.: 16/850,811

(22) Filed: Apr. 16, 2020

(65) Prior Publication Data

US 2020/0329885 A1 Oct. 22, 2020

Related U.S. Application Data

(60) Provisional application No. 62/834,772, filed on Apr. 16, 2019.

(51) Int. Cl.

| | |
|---|---|
| ***A47D 15/00*** | (2006.01) |
| ***A47C 21/08*** | (2006.01) |
| ***A47C 20/02*** | (2006.01) |
| ***A47C 23/00*** | (2006.01) |
| *A47G 9/10* | (2006.01) |

(52) U.S. Cl.

CPC ..... *A47D 15/008* (2013.01); *A47C 20/02* (2013.01); *A47C 21/08* (2013.01); *A47C 23/007* (2013.01); *A47D 15/005* (2013.01); *A47G 9/10* (2013.01)

(58) Field of Classification Search

CPC ..... A47D 15/008; A47D 15/005; A47D 7/00; A47D 13/068; A47D 13/066; A47C 23/007; A47C 21/08; A47G 9/10

See application file for complete search history.

(56) References Cited

U.S. PATENT DOCUMENTS

| | | | | |
|---|---|---|---|---|
| 4,876,755 A * | 10/1989 | Parrish | A47C 7/425 297/284.3 |
| 5,165,130 A * | 11/1992 | Wendling | A47D 13/08 5/424 |
| 10,827,843 B2 * | 11/2020 | Miller | A47G 9/1045 |
| 2002/0056159 A1 * | 5/2002 | Bravo | A47C 21/08 5/425 |

OTHER PUBLICATIONS

"Operation." Merriam-Webster, Merriam-Webster, www.merriam-webster.com/dictionary/operation.*

* cited by examiner

*Primary Examiner* — David R Hare
*Assistant Examiner* — Madison Emanski
(74) *Attorney, Agent, or Firm* — William G. Heedy; The Van Winkle Law Firm

(57) ABSTRACT

A convertible bed bumper apparatus includes first and second elongate members each including a flat side extending between opposing first and second flat ends; a first fastening element at the first flat end of the first elongate member and a second fastening element at the first flat end of the second elongate member; the first and second elongate members being integrally joined together adjacent the respective flat sides of the respective first flat ends; the first and second elongate members being selectively operable between a stowed configuration, wherein the respective flat sides of the first and second elongate members are brought into congruent abutment, and an operational configuration, wherein the respective first flat ends of the first and second elongate members are brought into congruent abutment; the first and second fastening elements being sized and configured for engagement when the first and second elongate members are in the operational configuration.

6 Claims, 5 Drawing Sheets

CONVERTIBLE BED BUMPER APPARATUS

RELATED APPLICATION

This application claims the benefit of U.S. Provisional Patent Application Ser. No. 62/834,772 filed on Apr. 16, 2019.

FIELD OF THE INVENTION

This invention relates to a portable bed guard and, more particularly, a portable device easy for travel that can be used as a bed bumper and as a pillow.

BACKGROUND OF THE INVENTION

Generally, bed guards are elongate structures provided for securement at opposite, lengthwise sides of a bed or mattress for reducing the risk of people, such as toddlers and the elderly, from falling out of bed during their sleep. Some bed guards employ side rails affixed to the bed, while others utilize integral ridges on both sides of the mattress. Further inventions use pockets along both sides of the sheet that bumpers are inserted into the pockets as the barriers. More recently, portable bed bumpers have been invented, but they are long and bulky, making transportation of the portable bed bumpers somewhat cumbersome.

Therefore, with the above problems taken into consideration, there exists a need for an improved portable bed bumper that is ideally configurable for travel and better suitable for versatile use.

SUMMARY OF THE INVENTION

In accordance with one form of the present invention, there is provided a convertible bed bumper apparatus including first and second elongate members; each of the first and second elongate members including a flat side extending between opposing first and second flat ends; a first fastening element at the first flat end of the first elongate member and a second fastening element at the first flat end of the second elongate member; the first and second elongate members being integrally joined together adjacent the respective flat sides of the respective first flat ends; the first and second elongate members being selectively operable between a stowed configuration, wherein the respective flat sides of the first and second elongate members are brought into congruent abutment, and an operational configuration, wherein the respective first flat ends of the first and second elongate members are brought into congruent abutment; the first and second fastening elements being sized and configured for engagement when the first and second elongate members are in the operational configuration.

In accordance with another form of the present invention, there is provided a convertible bed bumper apparatus including first and second elongate members; each of the first and second elongate members including a flat side extending between opposing first and second flat ends; a first fastening element at the first flat end of the first elongate member and a second fastening element at the first flat end of the second elongate member; the first and second elongate members being selectively joined together adjacent the respective flat sides of the respective first flat ends; the first and second elongate members being selectively operable between a stowed configuration, wherein the respective flat sides of the first and second elongate members are brought into congruent abutment, and an operational configuration, wherein the respective first flat ends of the first and second elongate members are brought into congruent abutment; the first and second fastening elements being sized and configured for engagement when the first and second elongate members are in the operational configuration.

BRIEF DESCRIPTION OF THE DRAWINGS

For a fuller understanding of the nature of the present invention, reference should be made to the following detailed description, taken in conjunction with the accompanying drawings in which.

DETAILED DESCRIPTION OF THE PREFERRED EMBODIMENTS

Referring to the several views of the drawings, the convertible bed bumper apparatus is shown and described herein and is generally indicated as 10.

Figure 2:
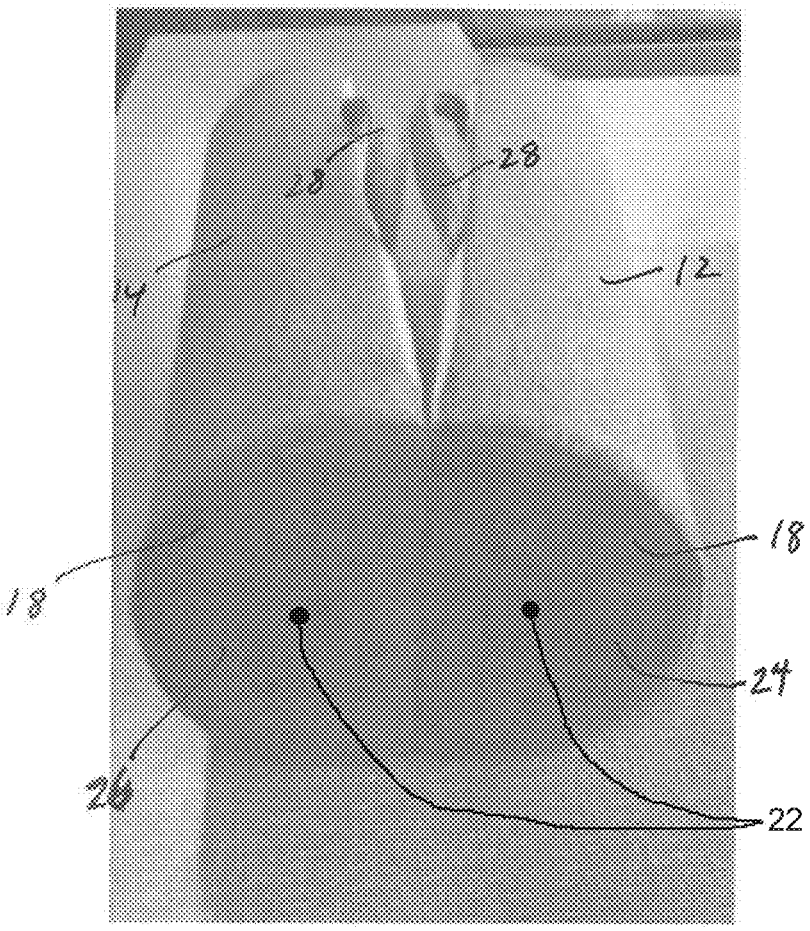
FIG. 2 is a perspective view of the convertible bed bumper apparatus illustrating the first flats ends of each of the first and second elongate members.

The convertible bed bumper apparatus 10 includes first and second elongate members 12 and 14, each including a flat side 16 extending between opposing first and second flat ends 18 and 20 and each having a cross-section 22 (FIG. 2). In one non-limiting embodiment, each of the first and second elongate members have a semi-cylindrical cross-section, as shown throughout the drawings. In another non-limiting embodiment, the first and second elongate members have a triangular cross-section. Other suitable cross-sections for the first and second elongate members may be used as well. The first and second elongate members 12 and 14 may be integrally joined together adjacent the respective flat sides 16 of the respective first and second elongate members 12 and 14, defining a first configuration or, alternatively, may be selectively joined together adjacent the respective first flat ends 18, defining a second configuration. In one non-limiting embodiment, the first and second elongate members are stitched together.

Referring specifically to FIG. 2, the first flat end 18 of the first elongate member 12 includes a hook fastening element 24 and the first flat end 18 of the second elongate member 14 includes a loop fastening element 26. While the first and second fastening elements 24 and 26 are shown throughout the Figures as hook and loop fastening elements, other fastening elements may be used, as well.

Figure 5:
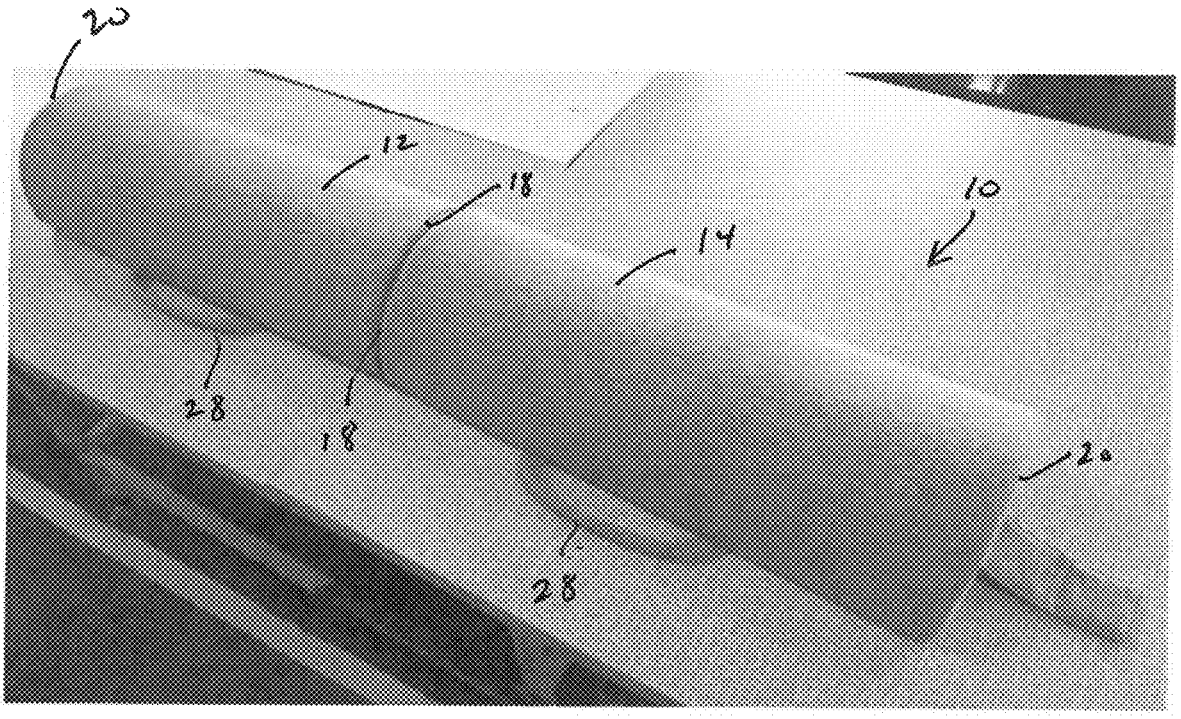
FIG. 5 is a perspective view of the convertible bed bumper apparatus illustrating the first and second elongate members in the operational configuration.

The first and second elongate members 12 and 14 are selectively operable between a stowed configuration (see FIG. 1), wherein the respective flat sides of the first and second elongate members are brought into congruent abutment, and an operational configuration (see FIG. 5), wherein the respective first flat ends 18 of the first and second elongate members 12 and 14 are brought into congruent abutment. The hook and loop fastening elements 24 and 26 are sized and configured to be fastened when the first and second elongate members 12 and 14 are in the operational configuration.

Figure 1:
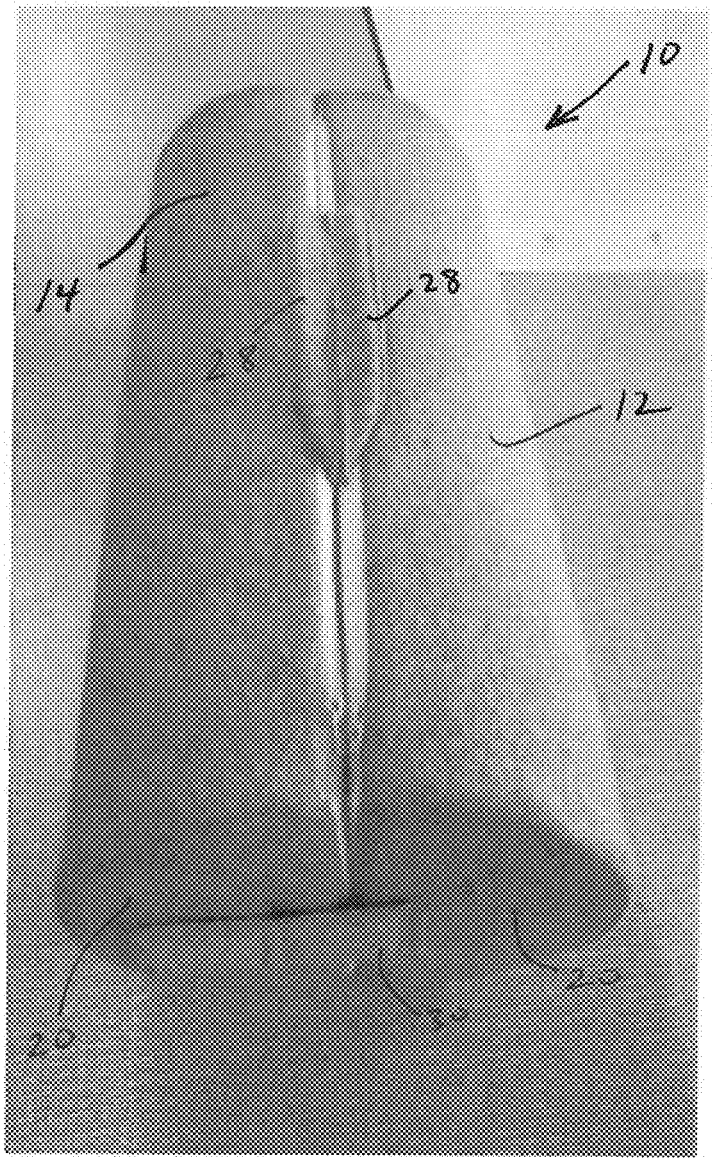
FIG. 1 is a perspective view of the convertible bed bumper apparatus illustrating the first and second elongate members in the stowed configuration.

When in the operational configuration, the convertible bed bumper apparatus 10 serves as a bed bumper. A convertible bed bumper 10 in the operational configuration may be positioned along the side of a bed to prevent an individual from inadvertently rolling off of the bed. First and second convertible bed bumpers 10 in the operational configuration may be positioned at opposing sides of a bed to prevent an individual from inadvertently rolling off of the bed. When in the stowed configuration, the convertible bed bumper apparatus 10 may serve as a pillow. Additionally, the convertible bed bumper apparatus 10 is ideally configured to be transported when in the stowed configuration. Referring to FIG. 1, handles 28 on each of the first and second elongate members 12 and 14 are ergonomically positioned for assisting in carrying the convertible bed bumper apparatus 10 when in the stowed configuration.

Figure 3:
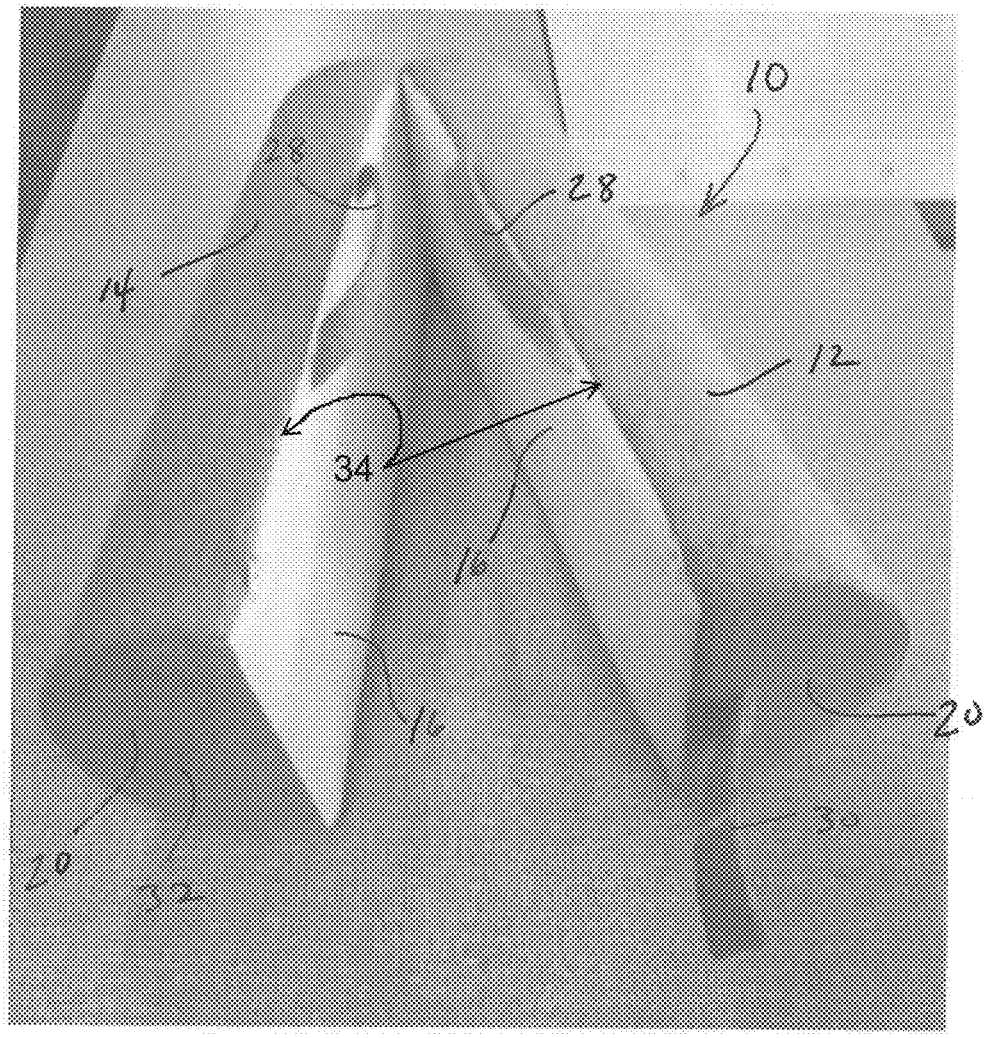
FIG. 3 is a perspective view of the convertible bed bumper apparatus illustrating the second flats ends of each of the first and second elongate members.
Figure 4:
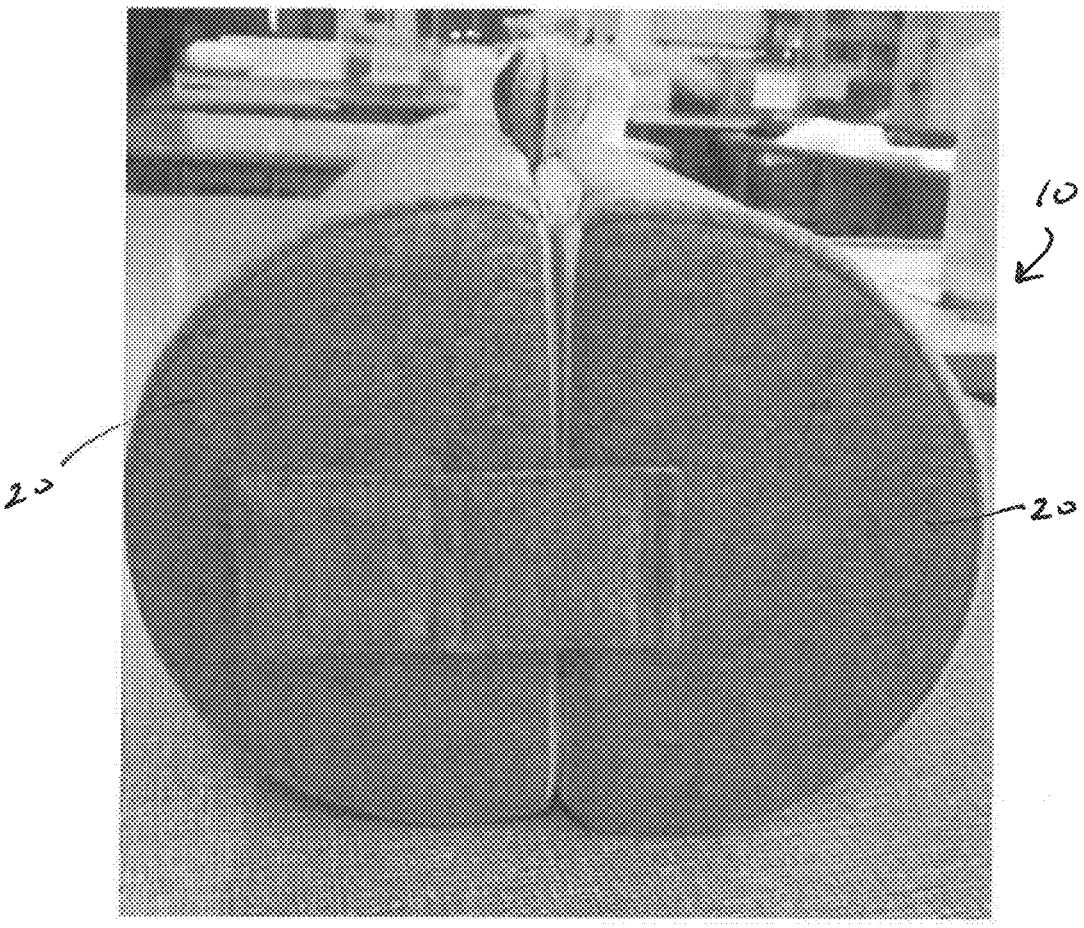
FIG. 4 is a side elevational view of the convertible bed bumper apparatus illustrating the first and second elongate members in the stowed configuration.

Referring to FIGS. 3 and 4, secondary fastening elements 30 and 32, such as hook and loop fasteners, on the second flat ends 20 of the first and second elongate members 12 and 14 may be used to selectively secure the convertible bed bumper apparatus 10 in the stowed configuration. The secondary fastening elements 30 and 32, while shown in the Figures secured to the second flat ends 20 of the first and second elongate members 12 and 14, may also be secured along the length of the first and second elongate members 12 and 14.

In one embodiment, separate elongate members 12 and 14 are removable, such that an outer layer 34 (FIG. 3), which is configured for receipt of the separate elongate members 12 and 14, may be washed and cleaned when necessary. In one non-limiting embodiment, the separate elongate members 12 and 14 are formed from foam.

While the present invention has been shown and described in accordance with several preferred and practical embodiments, it is recognized that departures from the instant disclosure are contemplated within the spirit and scope of the present invention.

What is claimed is:

1. A convertible bed bumper apparatus comprising:

first and second elongate members;

each of the first and second elongate members including a flat side extending between opposing first and second flat ends;

a first fastening element located on the first flat end of the first elongate member and a second fastening element located on the first flat end of the second elongate member, the first and second fastening elements being sized and configured for releasable engagement with each other;

the first and second elongate members being integrally joined together adjacent the respective flat sides of the respective first flat ends;

the first and second elongate members being selectively operable between a stowed configuration, wherein the respective flat sides of the first and second elongate members are configured to be brought into congruent abutment, and an operational configuration, wherein the respective first flat ends of the first and second elongate members are configured to be brought into congruent abutment and the first and second fastening elements are configured to be brought into releasable engagement with each other when the first and second elongate members are in the operational configuration.

2. A convertible bed bumper apparatus comprising:

first and second elongate members;

each of the first and second elongate members including a flat side extending between opposing first and second flat ends;

a first fastening element located on the first flat end of the first elongate member and a second fastening element located on the first flat end of the second elongate member, the first and second fastening elements being sized and configured for releasable engagement with each other;

the first and second elongate members being selectively joined together adjacent the respective flat sides of the respective first flat ends;

the first and second elongate members being selectively operable between a stowed configuration, wherein the respective flat sides of the first and second elongate members are configured to be brought into congruent abutment, and an operational configuration, wherein the respective first flat ends of the first and second elongate members are configured to be brought into congruent abutment and the first and second fastening elements are configured to be brought into releasable engagement with each other when the first and second elongate members are in the operational configuration.

3. The convertible bed bumper apparatus of claim 1, and further comprising:

a third fastening element located on the second flat end of the first elongate member and a fourth fastening element located on the second flat end of the second elongate member, the third and fourth fastening elements being sized and configured for releasable engagement to hold the first and second elongate members in the stowed configuration.

4. The convertible bed bumper apparatus of claim 1, and further comprising:

a first handle on the first elongate member and positioned midway between the first flat end and the second flat end of the first elongate member; and a second handle on the second elongate member and positioned midway between the first flat end and the second flat end of the second elongate member.

5. The convertible bed bumper apparatus of claim 2, and further comprising:

a third fastening element located on the second flat end of the first elongate member and a fourth fastening element located on the second flat end of the second elongate member, the third and fourth fastening elements being sized and configured for releasable engagement to hold the first and second elongate members in the stowed configuration.

6. The convertible bed bumper apparatus of claim 2, and further comprising:

a first handle on the first elongate member and positioned midway between the first flat end and the second flat end of the first elongate member; and a second handle on the second elongate member and positioned midway between the first flat end and the second flat end of the second elongate member.

* * * * *